US005332130A

United States Patent [19]

Spronk et al.

[11] Patent Number: 5,332,130

[45] Date of Patent: Jul. 26, 1994

[54] BOX-LIKE PACKAGING WITH DISPENSING OPENING

[75] Inventors: Johannes F. Spronk, Lelystad-Haven; Jan G. Abbing, Huizen; Jacobus P. J. Laanen, Loosdrecht, all of Netherlands

[73] Assignee: 'S-Gravelandseweg 6, The Netherland, Netherlands

[21] Appl. No.: 9,216

[22] Filed: Jan. 26, 1993

[30] Foreign Application Priority Data

Jul. 8, 1992 [NL] Netherlands ..... 9201217

[51] Int. Cl.[5] ..... B67D 3/00

[52] U.S. Cl. ..... 222/528; 222/531; 229/122

[58] Field of Search ..... 222/528, 531; 229/122, 229/125.15

[56] References Cited

U.S. PATENT DOCUMENTS

| | | | |
|---|---|---|---|
| 2,007,553 | 7/1935 | Vincent | 222/531 |
| 2,757,830 | 8/1956 | Hansen | 222/528 |
| 2,842,302 | 7/1958 | Ryder | 229/215 |
| 3,315,866 | 4/1967 | Kersh et al. | 222/528 |
| 3,567,102 | 3/1971 | Miller | 229/122 |
| 3,957,180 | 5/1976 | Skillman | 222/528 |

FOREIGN PATENT DOCUMENTS

| | | | |
|---|---|---|---|
| 717847 | 9/1965 | Canada | 229/122 |
| 9200075 | 6/1992 | Netherlands . | |

*Primary Examiner*—Andres Kashnikow
*Assistant Examiner*—Phillippe Derakshani
*Attorney, Agent, or Firm*—Kinney & Lange

[57] ABSTRACT

A box-like packaging includes a plurality of walls joined together through a plurality of edges or and a dispensing opening. The dispensing opening is, constructed on the basis of the corners of the hexagon, of which a first and a fourth corner are located on an edge of the packaging and a second and third corner are provided on a first wall bounding the edge, and a fifth and a sixth corner are provided in a second wall bounding the edge, wherein, to form a semiregular hexagon, the second and sixth corners and the third and fifth corners, respectively, are provided symmetrically relative to the edge, wherein the first and second, the second and third, the first and sixth and the fifth and sixth corners are connected through bending lines, wherein the third and fifth corners are each connected with a first common point on the edge through a cutting line, such that the bending lines and cutting lines and the edge define two closed wall portions each located in one of the walls bounding the edge.

28 Claims, 3 Drawing Sheets

BOX-LIKE PACKAGING WITH DISPENSING OPENING

BACKGROUND OF THE INVENTION

The invention relates to a box-like packaging with openable and closable dispensing opening and comprising at least one edge.

Box-like packagings of said type are applied on a large scale for pourable materials, such as food-stuffs, for example sandwich filling, or washing powder. In a known box-like packaging of this type an aluminum pouring lip is applied which closes a dispensing opening and which can be pivoted outwardly relative to the packaging for giving free the dispensing opening.

It is an object of the invention to provide a new box-like packaging of which the use is extremely versatile.

SUMMARY OF THE INVENTION

Thus the box-like packaging according to the invention is characterized in that the dispensing opening is provided at an edge of the packaging and comprises two symmetrically shaped material portions extending at opposite sides of the edge and joining one another, said portions each at one side intersecting said edge being severed from the packaging through a cutting line while at the remaining sides being connected with the packaging through pre-formed bending lines.

For opening the dispensing opening in order to dispense the contents of the box-like packaging an inwardly directed pressure has to be applied on the edge between the two material portions, such that these material portions snap inwardly relative to the packaging whereby the dispensing opening is opened at the cutting lines.

According to a preferred embodiment of the box-like packaging according to the invention each material portion substantially is defined starting from the corners of a regular hexagon, wherein the line between the first and fourth corners coincides with said edge and wherein between the first and second (first and sixth, respectively) corners as well as between the second and third (sixth and fifth, respectively) corners bending lines extend, whereas the cutting line extends between the third (fifth, respectively) corner and the edge. As a result of such a constructive configuration of the material portions it is safeguarded that the dispensing opening is shaped in a well-defined and reproducable way, wherein the bending lines cause a smooth movement of the material portions.

Starting from a packaging shaped in such a way two possibilities apply. In correspondence with a first possibility further bending lines extend between the second (sixth, respectively) corner and the imaginary centre of the regular hexagon positioned on said edge.

Due to the application of such bending lines in both material portions it is assured, that the material portions remain in the position giving free the dispensing opening, until through an appropriate manipulation of the packaging the dispensing opening is closed again. Such an appropriate manipulation comprises applying a pressure on the outside of the packaging at opposite sides of the material portions, thus generating tensions which move the material portions back towards the closed position of the dispensing opening.

If such bending lines between the second (sixth, respectively) corner and the mentioned imaginary center are not applied the material portions (after removing the pressure on the edge) will automatically return to the position in which the dispensing opening is closed. So, in such a case the dispensing opening only will be kept in an opened position when the pressure on the edge is maintained.

Further it is possible, that the cutting line extends substantially perpendicularly to the edge. By the provision of such a cutting line the respective section of the material portions will be displaced inwardly relative to the packaging when opening the dispensing opening. However, it is possible too that the cutting line extends between the third (fifth, respectively) and fourth corners, whereas further bending lines extend between the third (fifth, respectively) corner and the imaginary centre of the regular hexagon. As a result of a cutting line shaped like this and as a result of the application of such bending lines extending between the third (fifth, respectively) corner and the imaginary centre a configuration is obtained in which, when opening the dispensing opening, the section of the material portions positioned above said bending lines is displaced inwardly, whereas however the section positioned between said bending lines and the cutting line is at the same time pivoted outwardly. Thus as it were a pouring spout is realised.

Although the cutting lines and bending lines most simply will comprise straight lines, the possibility exists that at least some of the cutting lines and/or bending lines comprise curved lines, preferably arcs of a circle.

Such arcs of a circle could for example define portions of a circle extending through the corners of the regular hexagon.

Moreover an alternative embodiment of the box-like packaging according to the invention is mentioned, in which each material portion is defined starting from the corners of a semi-regular hexagon of which the distance between the second and third (sixth and fifth, respectively) corners is a multiple of the distance between the other corners. Thus, in such a case the material portions are elongated. With respect to the embodiments having a dispensing opening closing automatically or non-automatically, or a pouring spout pivoting outwardly or not, respectively, the same possibilities apply as to the earlier mentioned packaging starting from an entirely regular hexagon. One should only realise that now as it were a number of imaginary centres are present on the edge. Such an embodiment may be applied for packagings containing poisonous or corrosive materials. Due to the elongated material portions the distance between the dispensing opening and the fingers of a user remains large and thus safe.

As has been mentioned previously, when using an embodiment of the packaging which does not close automatically, pressure should be applied at opposite sides of the material portions for closing the dispensing opening. For opening the dispensing opening pressure is applied onto the edge. In order to simplify these operations an embodiment of the packaging is proposed, in which at opposite sides of the material portions as well as on the edge marking points have been provided.

Further an embodiment is handy, which is characterized by a compartment defined in its interior and near to the dispensing opening, said compartment in the closed position of the dispensing opening freely communicating with the interior of the packaging and in the opened position of the dispensing opening being separated from the interior of the packaging through the material portions but communicating with the surroundings through the dispensing opening. In such an embodiment the compartment is automatically filled with material from the packaging when the dispensing opening is closed. After the dispensing opening has been opened this amount of material is dispensed from the compartment through the dispensing opening of the packaging, without additional material entering said compartment. Thus a measured material delivery is obtained.

Constructively such a packaging may be realised such, that the compartment is defined by two wall portions engaging the packaging walls that adjoin the edge as well as the packaging wall extending substantially perpendicularly thereto.

BRIEF DESCRIPTION OF THE DRAWINGS

Hereinafter the invention will be elucidated further referring to the drawing, in which a number of embodiments of the packaging are illustrated.

DETAILED DESCRIPTION OF THE PREFERRED EMBODIMENTS

Figure 1:
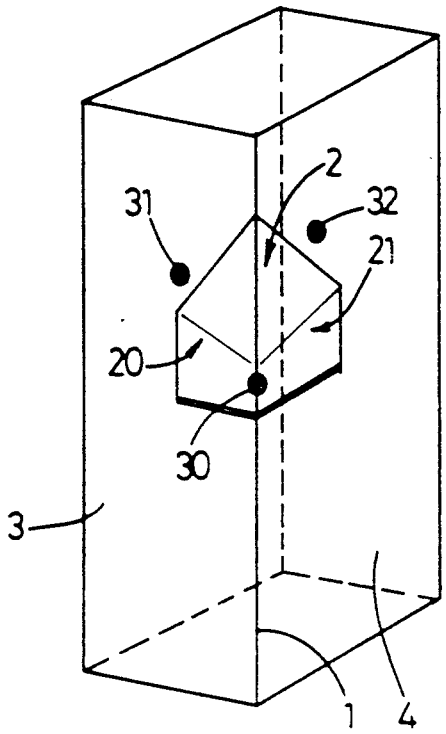
FIG. 1 shows perspectively a first embodiment of a packaging according to the invention with closed dispensing opening.
Figure 2:
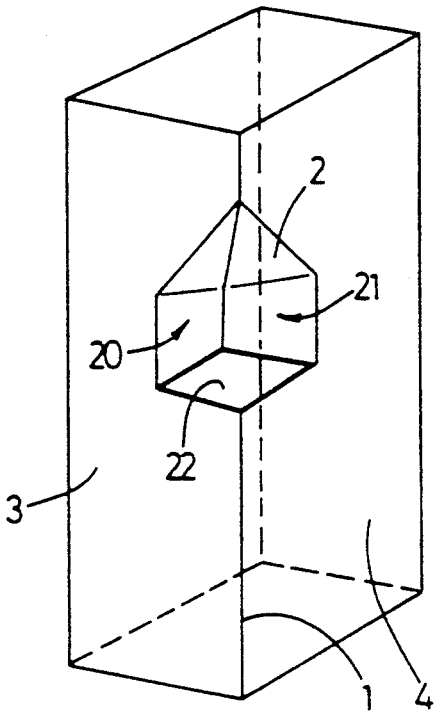
FIG. 2 shows the same packaging with opened dispensing opening.

In FIG. 1 and FIG. 2 a box-like packaging is illustrated in an edge 1 of which an openable and closable dispensing opening 2 is provided. FIG. 1 shows that the dispensing opening is closed, whereas FIG. 2 shows that the dispensing opening is opened.

Figure 3:
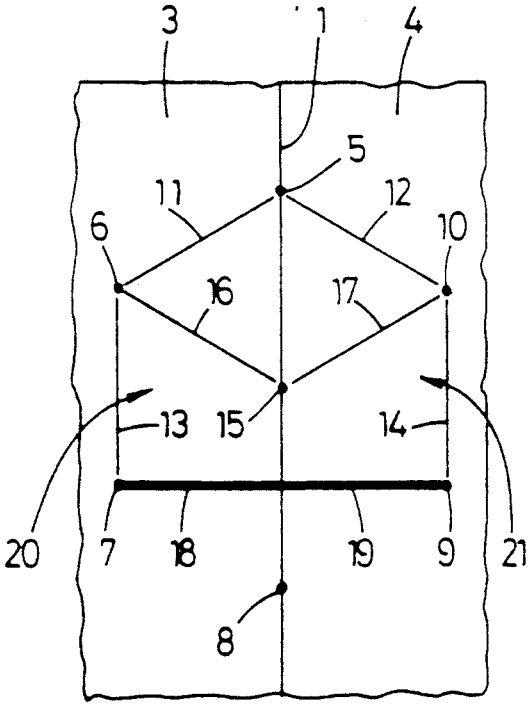
FIG. 3 shows schematically the fabrication of the dispensing opening according to FIG. 1 and FIG. 2.

Referring to FIG. 3 it is elucidated now how the dispensing opening is defined. In FIG. 3 each sidewalls 3 and 4 of the packaging according to FIG. 1 and 2 is positioned in a flat plane. The respective edge 1 is the intersection of said flat planes. Further six consecutive corners 5–10 of a regular hexagon are illustrated. The first corner 5 and the fourth corner 8 are positioned on the edge 1. Between the first corner 5 and the second corner 6 as well as the first corner 5 and the sixth corner 10, respectively, bending lines 11 and 12 extend. These bending lines are pre-formed in the material (for example cardboard) of which the packaging is made. Further bending lines extend between the second corner 6 and the third corner 7 as well as between the sixth corner 10 and the fifth corner 9, respectively. These bending lines have been referenced with 13 and 14. Finally bending lines 16 and 17 extend between the second corner 6 and the imaginary centre 15 of the hexagon as well as between the sixth corner 10 and this centre. Further one can see that cutting lines 18 and 19 are provided between the third corner 7 and the edge 1 as well as between the fifth corner 9 and said edge 1, at which the material of the packaging has been completely cut through.

Due to the previously mentioned pattern of bending lines and cutting lines two material portions 20 and 21 are defined which are respectively enclosed by the bending lines 11 and 13, cutting line 18 and edge 1 as well as bending lines 12 and 14, cutting line 19 and the edge 1. In the closed position of the dispensing opening these material portions are positioned in the plane of the respective side walls 3 and 4 of the packaging. When the dispensing opening is to be opened an inwardly directed pressure is applied onto the edge 1 (for example at a marking point 30 provided on said edge), as a result of which the material portions move inwardly relative to said sidewalls 3, 4, such that in correspondence with FIG. 2 an opening 22 is created. Through this opening material present in the packaging, such as sandwich filling, washing powder or alike, can be dispensed.

The bending lines 16 and 17 contribute to the creation of a pattern of forces in the material of the packaging as result of which the material portions 20 and 21, once being pushed inwardly relative to the sidewalls 3 and 4, remain in this inward position. For closing the opening 22 pressure should be applied onto the packaging at opposite sides of the material portions 20 and 21 (for example at marking points 31 and 32). If these bending lines 16 and 17 are not provided the material portions 20 and 21, after removing the pressure onto the edge 1, will automatically regain there original position (in the plane of the respective side walls 3 and 4) without the need of applying a pressure onto the packaging.

Figure 4:
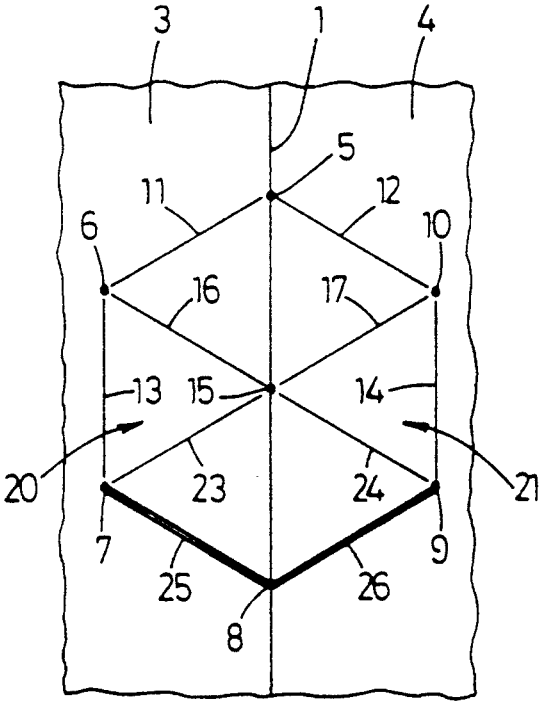
FIG. 4 shows schematically the fabrication of a different dispensing opening.
Figure 5:
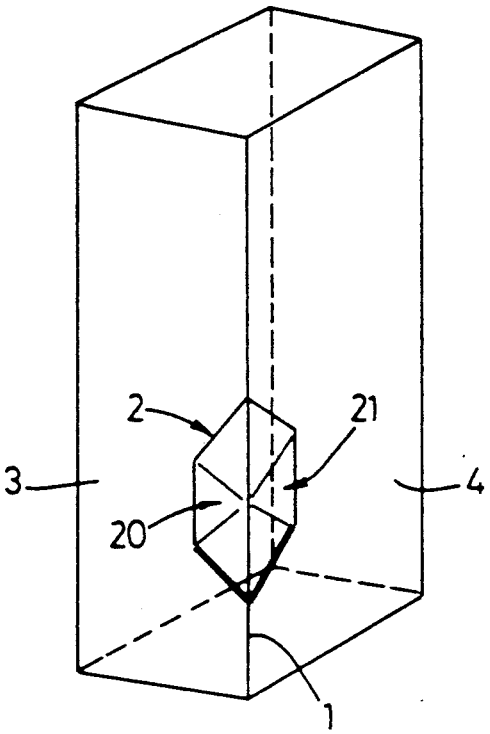
FIG. 5 shows perspectively a box-like packaging, which is provided with the dispensing opening illustrated in FIG. 4 and in closed position.
Figure 6:
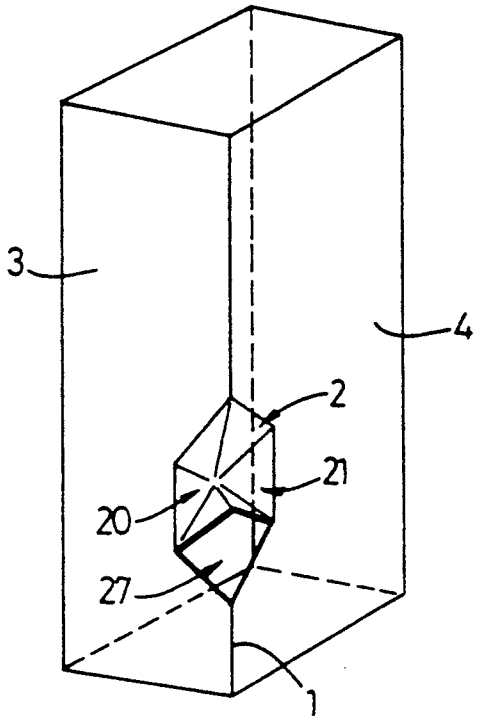
FIG. 6 shows the packaging illustrated in FIG. 5 in the opened position.

In FIG. 4 a different embodiment of the dispensing opening is shown, belonging to the packaging illustrated in FIG. 5 and 6. In correspondence with the subject matter shown in FIG. 3 now again bending lines 11–14 and 16, 17 are present. However, in this case bending lines 23 and 24 are present extending between the third corner 7 and the imaginary centre 15 as well as between the fifth corner 9 and this imaginary centre 15. Further it appears, that the cutting lines do now extend between the third corner 7 and fourth corner 8 as well as between the fifth corner 9 and the fourth corner 8, respectively. These cutting lines have been referenced 25 and 26. Thus the material portions 20 and 21 differ in shape from the material portions according to FIG. 3.

If the dispensing opening illustrated in FIG. 4 has to be opened an inward pressure is applied again onto the edge 1. As a result the sections of the material portions being enclosed by bending lines 11, 13, 23 and the edge 1 or bending lines 12, 14, 24 and the edge 1, respectively, are displaced inwardly, whereas however the material sections being enclosed by the bending line 23, the cutting line 25 and the edge 1 or the bending line 24, the cutting line 26 and the edge 1, respectively, are pivoted outwardly. Starting from the closed position illustrated in FIG. 5 of the dispensing opening created like this, in correspondence with FIG. 6 as it were a pouring spout is defined enclosing an opening 27. For closing said opening 27 one can again act as described in relation to the embodiment according to the FIG. 1-3.

In FIG. 7 again schematically the fabrication of a different embodiment of the dispension opening is illustrated, in which the two side walls 3 and 4 of the packaging are positioned in the same plane. This dispensing opening substantially corresponds with the dispensing opening illustrated in FIG. 3, but now the bending lines 13 and 14 are replaced by bending lines 28 and twice as long. Further the marking points 30-32, which already have been indicated on the packaging in FIG. 1, are visible now in FIG. 7. In order to open the dispensing opening pressure should be applied onto edge 1, as has been marked by marking point 30. For closing the dispensing opening pressure should be applied onto the packaging sideways of the material portions 20 and 21, as indicated by marking points 31 and 32. Of course the marking points 31 and 32 are not necessary, if an embodiment has been chosen without bending lines 16 and 17, such that the material portions will automatically regain a closed position when the force applied onto the edge 1 (at the marking point 30) is removed.

Figure 7:
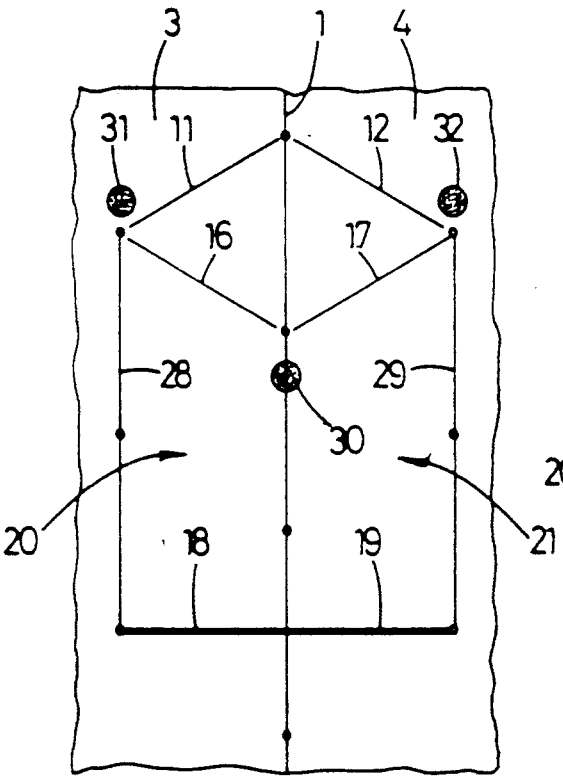
FIG. 7 shows schematically the fabrication of a different embodiment of the dispensing opening according to the invention, which further comprises marking points.
Figure 8:
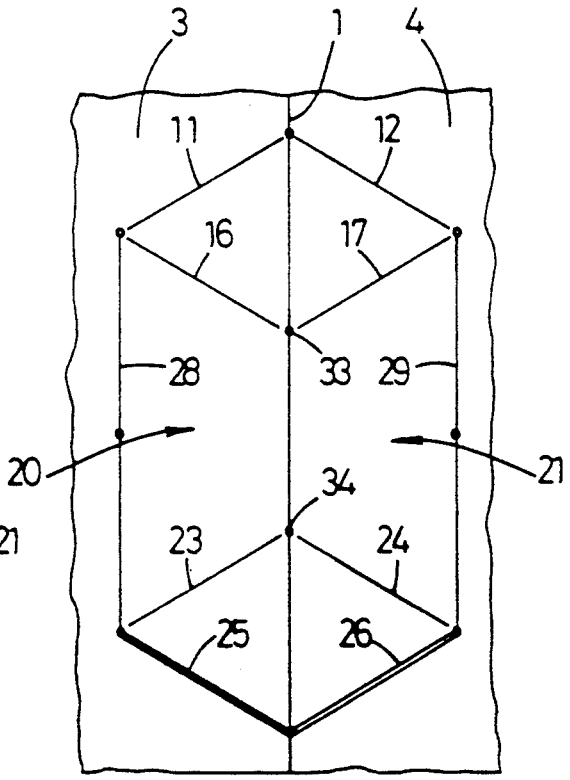
FIG. 8 shows schematically the fabrication of a further embodiment of the dispensing opening according to the invention.

In FIG. 8 an embodiment of the dispensing opening is illustrated in a corresponding schematic way, said embodiment, in correspondence with the dispensing opening illustrated in FIG. 7, comprising longer bending lines 28 and 29. For the rest this dispensing opening corresponds with the dispensing opening shown in FIG. 4, realising however, that now as it were two imaginary centres 33 and 34 are provided.

Figure 9:
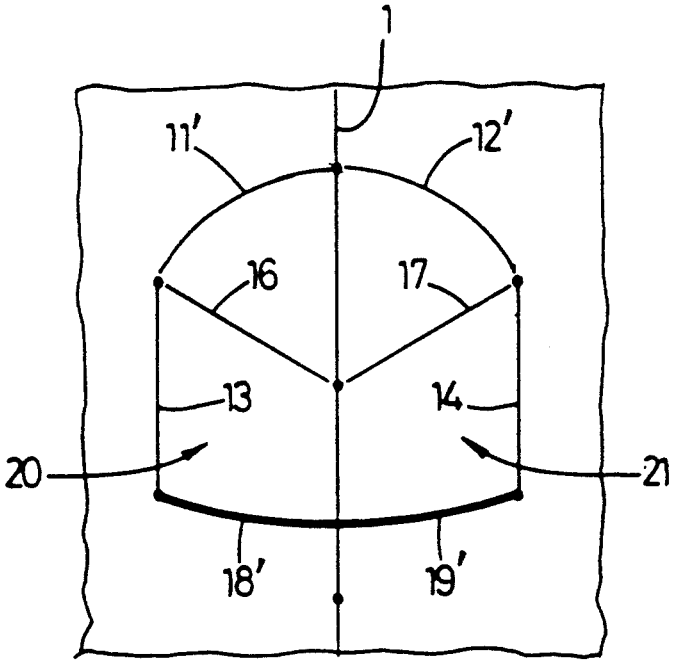
FIG. 9 shows schematically the fabrication of a still further embodiment of the dispensing opening according to the invention.

FIG. 9 shows an embodiment of the dispensing opening which substantially corresponds with the embodiment shown in FIG. 3, wherein however some of the bending lines 11' and 12' as well as cutting lines 18' and 19' are curved. More specificly these curved cutting lines 18' and 19' and bending lines 11' and 12' respectively, may have the form of an arc of a circle. These arcs of a circle could comprise sections of a circle circumscribing the regular hexagon, as is the case at the bending lines 11' and 12'.

Figure 10:
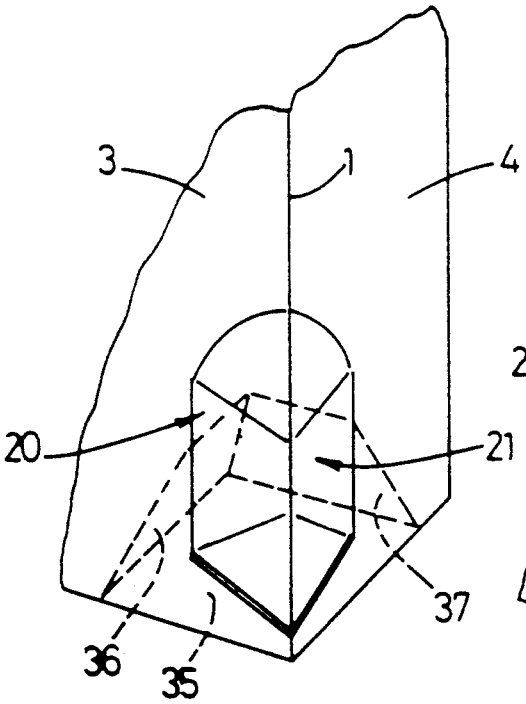
FIG. 10 shows perspectively and in the closed position part of a box-like packaging according to the invention, which is provided with a measurement device.
Figure 11:
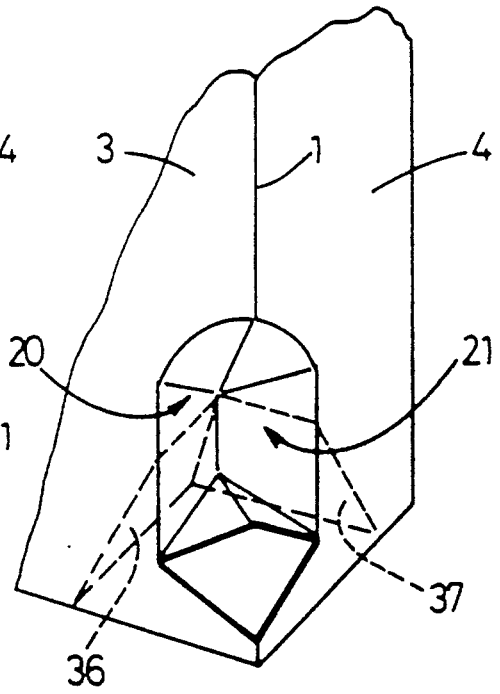
FIG. 11 shows the packaging illustrated in FIG. 10 in the opened position.

In FIG. 10 that part of a packaging is illustrated where a dispensing opening is provided. In the interior of the packaging two wall portions 36 and 37 engage the two side walls 3 and 4 as well as the bottom 35. In FIG. 10 the dispensing opening is closed, and the compartment enclosed by the wall portions 36, 37, the side walls 3, 4 and bottom 35 communicates at its top side with the interior of the packaging, such that material present in the packaging may flow into this compartment. When next in correspondence with FIG. 11 the dispensing opening is opened the material portions 20 and 21 move inwardly and engage the free upper edges of the wall portions 36 and 37. As a result said compartment is closed at its top side such that no longer material flowes from the packaging into said compartment. At this moment however the interior of said compartment communicates with the surroundings through the dispensing opening that is opened now, such that the contents of the compartment flows outwardly. By again closing the dispensing opening the compartment can be refilled. A repetition of these operations leads to a measured discharge of material from the packaging.

The invention is not limited to the embodiments described before, which may be varied widely within the scope of the invention. In this connection the following is noted. In the above description repeatedly material portions are mentioned extending at opposite sides of an edge. Such an edge defines the boundary between two adjoining sides of the packaging enclosing an angle. However, the invention is applicable too to a curved side of a packaging; one should realise that such a curved or bend side as it were defines an endless amount of planes separated by edges and mutually enclosing an angle. A dispensing opening provided in such a curved side therefore is based on the principle of the invention too, although the respective edge cannot be defined physically.

What is claimed is:

1. A box-like packaging comprising:

a plurality of walls joined together through a plurality of edges thereof; and a dispensing opening, wherein the dispensing opening is, constructed on the basis of the corners of a hexagon, of which a first and fourth corner are located on an edge of the packaging and a second and a third corner are provided in a first wall bounding the edge, and a fifth and a sixth corner are provided in a second wall bounding the edge, wherein, to form a semiregular hexagon, the second and sixth corners and the third and fifth corners, respectively, are provided symmetrically relative to the edge, wherein the first and second, the second and third, the first and sixth, the fifth and sixth corners are connected through bending lines, wherein the third and fifth corners are each connected with a first common point on the edge through a cutting line, such that the bending lines and cutting lines and the edge define two closed wall portions each located in one of the walls bounding the edge, and wherein no bending lines are incorporated within the closed wall portions.

2. A box-like packaging according to claim 1, wherein the first common point is selected to be on the edge, such that the cutting lines, which are designed substantially as straight segments, extend substantially perpendicularly to the edge.

3. A box-like packaging according to claim 1, wherein at least a part of the bending lines is designed as straight-line segments.

4. A box-like packaging according to claim 1, wherein at least a part of the bending lines is designed as arcs of a circle.

5. A box-like packaging according to claim 1, further comprising a compartment formed in an interior of the packaging in proximity to the dispensing opening, said compartment in a closed position of the dispensing opening freely communicating with the interior of the packaging and in an opened position of the dispensing opening being separated from the interior of the packaging through the wall portions and communicating with the surroundings through the dispensing opening.

6. A packaging according to claim 5, wherein the compartment is formed by two panels engaging the walls adjacent to the edge and a wall of the packaging that extends substantially perpendicularly thereto.

7. A box-like packaging comprising:

a plurality of walls joined together through a plurality of edges thereof; and dispensing opening, wherein the dispensing opening is, constructed on the basis of the corners of a hexagon, of which a first and fourth corner are located on an edge of the packaging and a second and a third corner are provided in a first wall bounding the edge, and a fifth and a sixth corner are provided in a second wall bounding the edge, wherein, to form a semiregular hexagon, the second and sixth corners and the third and fifth corners, respectively, are provided symmetrically relative to the edge, wherein the first and second, the second and third, the first and sixth, and the fifth and sixth corners are connected through first bending lines, wherein the third and fifth corners are each connected with a first common point on the edge through a cutting line, such that the bending lines and cutting lines and the edge define two closed wall portions each located in one of the walls bounding the edge, and wherein each closed wall portion comprises a second bending line each connecting a second common point on the edge with the second and sixth corners, respectively, wherein the second common point on the edge is located in a zone bounded by two imaginary lines interconnecting the third and fifth corners and the second and sixth corners, respectively.

8. A box-like packaging according to claim 7, further comprising marking points on the walls comprising the dispensing opening adjacent the second and sixth corners and on the edge between the first and second common points.

9. A box-like packaging according to claim 7, wherein the first common point is selected to be on the edge, such that the cutting lines, which are designed substantially as straight line segments, extend substantially perpendicularly to the edge.

10. A box-like packaging according to claim 7, wherein at least a part of the bending lines is designed as straight-line segments.

11. A box-like packaging according to claim 7, wherein at least a part of the bending lines is designed as arcs of a circle.

12. A box-like packaging according to claim 7, further comprising a compartment formed in an interior of the packaging in proximity to the dispensing opening, said compartment in a closed position of the dispensing opening freely communicating with the interior of the packaging and in an opened position of the dispensing opening being separated from the interior of the packaging through the wall portions and communicating with the surroundings through the dispensing opening.

13. A packaging according to claim 12, wherein the compartment is formed by two panels engaging the walls adjacent to the edge and a wall of the packaging that extends substantially perpendicularly thereto.

14. A box-like packaging comprising:

a plurality of walls joined together through a plurality of edges thereof; and a dispensing opening, wherein the dispensing opening is constructed on the basis of the corners of a hexagon, of which a first and a fourth corner are located on an edge of the packing and a second and a third corner are provided in a first wall bounding the relevant edge, and a fifth and a sixth corner are provided in a second wall bounding the relevant edge, wherein, to form a semiregular hexagon, the second and sixth corners and the third and fifth corners, respectively, are provided symmetrically relative to the edge, wherein the first and second, the second and third, the first and sixth, and the fifth and sixth corners are connected through first bending lines, wherein the third and fifth corners are each connected with a first common point on the edge through a cutting line, such that the bending lines are cutting lines and the edge define two closed wall portions each located in one of the walls bounding the edge, wherein each wall portion comprises only one second bending line each connecting a second common point on the edge with the third and fifth corners, respectively, wherein the second common point on the edge is located in a zone bounded by two imaginary lines interconnecting the third and fifth corners and the second and sixth corners, respectively, wherein in an opened position of the dispensing opening the parts of the wall portions that are bounded by the cutting lines and the second bending lines are in an outwardly folded position remote from the box interior, while the parts of the wall portions that are bounded by the first and second bending lines are in an inwardly folded position proximal to the box interior.

15. A box-like packaging according to claim 14, wherein the second bending lines are straight line segments which are at a mutual angle of 120° when the box-like packaging is in an opened blank position.

16. A box-like packaging according to claim 14, wherein each wall portion comprises, a third bending line, said third bending lines each connecting a third common point on the edge with the second and sixth corners, respectively, wherein the third common point, is located in the zone and does not coincide with the second common point and wherein the second common point is located closer to the imaginary line connecting the third and fifth corners than is the third common point.

17. A box-like packaging according to claim 16, wherein the third bending lines are straight line segments which are at a mutual angle of 120° when the box-like packaging is in an opened blank position.

18. A box-like packaging according to claim 16, further comprising a plurality of marking points on the walls comprising the dispensing opening, outside the relevant wall portions, adjacent the second and sixth corners.

19. A box-like packaging according to claim 18, wherein a marking point is provided on the edge between the first and second common parts.

20. A box-like packaging according to claim 14, wherein at least a part of the bending lines is designed as straight-line segments.

21. A box-like packaging according to claim 14, wherein at least a part of the bending lines is designed as arcs of a circle.

22. A box-like packaging according to claim 14, further comprising a compartment formed in an interior of the packaging in proximity to the dispensing opening, said compartment in a closed position of the dispensing opening freely communicating with the interior of the packaging and in an opened position of the dispensing opening being separated from the interior of the packaging through the wall portions and communicating with the surroundings through the dispensing opening.

23. A packaging according to claim 22, wherein the compartment is formed by two panels engaging the walls adjacent to the edge and a wall of the packaging that extends substantially perpendicularly thereto.

24. A box-like packaging comprising:

a plurality of walls joined together through a plurality of edges thereof; and a dispensing opening, wherein the dispensing opening is constructed on the basis of the corners of a hexagon, of which a first and a fourth corner are located on an edge of the packaging and a second and a third corner are provided in a first wall bounding the relevant edge, and a fifth and a sixth corner are provided in a second wall bounding the relevant edge, wherein, to form a semiregular hexagon, the second and sixth corners and the third and fifth corners, respectively, are provided symmetrically relative to the edge, wherein the first and second, the second and third, the first and sixth, and the fifth and sixth corners are connected through first bending lines, wherein the third and fifth corners are each connected with a first common point on the edge through a cutting line, such that the first bending lines and cutting lines and the edge define two closed wall portions each located in one of the walls bounding the edge, wherein each wall portion comprises a second and a third bending line intersecting in a second common point, wherein the second bending lines connect the second common point with the third and fifth corners, respectively, wherein the third bending lines connect the second common point with the second and sixth corners, respectively, and wherein in an opened position of the dispensing opening the parts of the wall portions that are bounded by the cutting lines and the second bending lines are in an outwardly folded position remote from the box interior, while the parts of the wall portions that are bounded by the first and second bending lines are in an inwardly folded position proximal to the box interior, and wherein outside the wall portions at least one marking point is located adjacent the second and sixth corners and within the wall portions on the edge between the first and second common points.

25. A box-like packaging according to claim 18, wherein at least a part of the bending lines is designed as straight-line segments.

26. A box-like packaging according to claim 18, wherein at least a part of the bending lines is designed as arcs of a circle.

27. A box-like packaging according to claim 18, further comprising a compartment formed in an interior of the packaging in proximity to the dispensing opening, said compartment in a closed position of the dispensing opening freely communicating with the interior of the packaging and in an opened position of the dispensing opening being separated from the interior of the packaging through the wall portions and communicating with the surrounding through the dispensing opening.

28. A packaging according to claim 21, wherein the compartment is formed by two panels engaging the walls adjacent to the edge and a wall of the packaging that extends substantially perpendicularly thereto.

* * * * *

UNITED STATES PATENT AND TRADEMARK OFFICE

CERTIFICATE OF CORRECTION

PATENT NO. : 5,332,130

DATED : July 26, 1994

INVENTOR(S) : JOHANNES FREDERICUS SPRONK ET AL.

It is certified that error appears in the above-indentified patent and that said Letters Patent is hereby corrected as shown below:

On the Title Page delete [73] Assignee: 'S-Gravelandseweg 6, The Netherland, Netherlands insert [73] Assignee: Johannes Fredericus Spronk, Beemster 61, 8244 CE Lelystad-Haven, The Netherlands Col. 4, line 38, delete "there", insert --their--

Col. 5, line 9, delete "lines 28 and", insert --lines 28 and 29--

Col. 5, line 35, delete "specificly", insert --specifically--

Col. 5, line 54, delete "flowes", insert --flows--

Col. 6, line 37, delete "straight", insert --straight line--

UNITED STATES PATENT AND TRADEMARK OFFICE

CERTIFICATE OF CORRECTION

PATENT NO. : 5,332,130

DATED : July 26, 1994

INVENTOR(S) : Johannes Fredericus Spronk et al

It is certified that error appears in the above-indentified patent and that said Letters Patent is hereby corrected as shown below:

Column 6, line 61, delete "dispensing" (first occurrence, at beginning of line), insert --a dispensing --.

Column 10, line 21, delete "surrounding", insert --surroundings --.

Signed and Sealed this

Twenty-fifth Day of April, 1995

*Attest:*

*Attesting Officer*

BRUCE LEHMAN

*Commissioner of Patents and Trademarks*